US007079664B2

(12) United States Patent
Nassimi

(10) Patent No.: US 7,079,664 B2
(45) Date of Patent: Jul. 18, 2006

(54) WIRELESS EAR-PIECE WITH CONDUCTIVE CASE

(76) Inventor: Shary Nassimi, 2002 NW. 215 Cir., Ridgefield, WA (US) 98642

( * ) Notice: Subject to any disclaimer, the term of this patent is extended or adjusted under 35 U.S.C. 154(b) by 211 days.

(21) Appl. No.: 10/355,544

(22) Filed: Jan. 30, 2003

(65) Prior Publication Data

US 2004/0151337 A1 Aug. 5, 2004

(51) Int. Cl.
*H04R 25/00* (2006.01)

(52) U.S. Cl. ..... 381/380; 381/382; 381/328

(58) Field of Classification Search ..... 381/338, 381/370, 371, 380–382, 328, 330, 331; 379/430, 379/431; 455/90.2, 90.3, 575.1, 575.6, 575.7, 455/344, 351

See application file for complete search history.

(56) References Cited

U.S. PATENT DOCUMENTS 4,334,315 A * 6/1982 Ono et al. ..... 455/11.1
6,021,207 A * 2/2000 Puthuff et al. ..... 381/330
2004/0028218 A1* 2/2004 Rath et al. ..... 379/430

* cited by examiner

*Primary Examiner*—Huyen Le
(74) *Attorney, Agent, or Firm*—George R. McGuire; Bond, Schoeneck & King, PLLC

(57) ABSTRACT

The present invention teaches a wireless ear-piece headset forming an antenna with the interior of a human ear, especially the ear canal. An antenna in operative connection with such interior of such human ear greatly improves reception and transmission of the device. The antenna may be comprised of a conductive plastic forming the lower body of the ear-piece headset, a sound tube projecting from the body or only a part thereof. The antenna may form an efficient capacitive connection with the body or may form a direct electrical connection. The wireless ear-piece headset comprises a headset body; a microphone, a transceiver, a receiver and a battery within the headset body, and a sound tube projecting from the headset body. A mini-speaker disposed within the headset body passes sound from the mini-speaker out and into the interior of a human ear.

27 Claims, 5 Drawing Sheets

WIRELESS EAR-PIECE WITH CONDUCTIVE CASE

FIELD OF THE INVENTION

This invention relates generally to wireless headsets and specifically to a conductive or capacitive case for wireless ear-pieces.

BACKGROUND OF THE INVENTION

Cellular and office telephones are becoming smaller from year to year, thus offering users increased convenience. One logical extension of the telephone is the wireless headset. Wireless headsets provide convenience and safety to the users of such devices as office telephones and cellular phones, by allowing the user partially or completely hands free operation of the cell phone. This is of particular importance during office work, but is also important during operation of motor vehicles, athletic activities and similar times during which users require the use of two hands for other activities. Such headsets normally comprise some sort of bead band or ear clip to retain the headset in the proper position, a microphone located near the mouth, and such wireless equipment as is necessary to communicate with a base unit located at or on the cell phone or similar device. Note that there are also "wired" headsets which do not have the advantages of wireless connection between the base unit (attached to the cellular telephone or office telephone) and the headset portion.

However, the comfort and convenience of the wireless headset may be reduced by the method of maintaining the headset in position on the user's head. Head bands which cross over the top of the head quickly become uncomfortable and may slip out of position. Ear clips also suffer from the problem of discomfort.

Wireless headsets may now be reduced in size to an ear-piece, in which the comfort and sanitation of the user and the life span of the device may in increased by providing a replaceable compliant polymer sheath for the sound tube which is inserted into the ear canal: friction between the ear canal and the sheath retains the wireless ear-piece headset in the ear canal. In alternative embodiments, the sheath and ear canal may mechanically cooperate to retain the wireless ear-piece headset in the ear canal. The sheath may be easily removed and replaced so as to adapt the length and diameter of the device for the needs and comfort of different users. Just such an invention is the subject matter of co-pending U.S. patent application Ser. No. 10/261,367 filed Sep. 30, 2002 and entitled ADJUSTABLE EAR CANAL RETENTION TRANSCEIVER/RECEIVER, to the same inventor, Shary Nassimi.

One disadvantage of such headsets is the limited space available to the designer for an antenna. One possible arrangement (seen in the previously mentioned application) is to place the antenna in the microphone tube extending from the ear in the direction of the user's mouth. Other arrangements are possible.

The present invention concerns the use of the electrical and magnetic fields of the human body to boost the gain of a wireless telephony ear-piece.

The fact that the human body has a natural electromagnetic field is well known. Such fields may extend out from the body roughly 10 to 20 centimeters depending upon direction, the ambient electromagnetic environment, the individual body and other factors. The most common situation in which the effect of the body on antennas may be seen is that of attempting to adjust the antenna of an old-fashioned television set or radio: the human achieves good reception while actually adjusting the antenna, only to see the good reception vanish when the person lets go of the antenna or moves away from it.

A number of patents cite this effect on antennas positioned close to the human body, principally in reference to devices mounted on the wrist or arm.

U.S. Pat. No. 6,373,439, issued Apr. 16, 2002 to Zurcher et al, U.S. Pat. No. 5,926,144 issued Jul. 20, 1999 to Bolanos, and U.S. Pat. No. 3,983,483 issued Sep. 28, 1976 to Pando all mention these effects in passing in regard to wrist/arm bracelets. None relate to wireless headsets of any type, much less to wireless ear-piece headsets.

Another type of discussion of these effects may be found in U.S. Pat. No. 5,659,325 issued Aug. 19, 1997 to Belcher et al for LOW IMPEDANCE LOOP ANTENNA AND DRIVE CIRCUITRY, and U.S. Pat. No. 4,368,472 issued Jan. 11, 1983 to Gandhi for MICROWAVE DOSIMETER, both of which focus on methods of actually reducing capacitive or reflective effects of radiation on or from the human body.

Of greater interest are patents on radio apparatus for use near or on the human body, in which capacitive or direct connections are used to enhance reception and/or transmission.

U.S. Pat. No. 6,047,163 issued Apr. 4, 2000 to Miyoshi for MINIATURE RADIO APPARATUS HAVING LOOP ANTENNA INCLUDING HUMAN BODY teaches a wrist watch type double contact capacitive antenna in which the user is supposed to place one part of the body in contact with one terminal of the antenna while placing a different part of the body in contact with the other electrode, thus interposing the entire body as a dielectric layer and forming a large capacitor. (See FIG. 3 and FIG. 4 of the '163 patent). This is in contrast to applications in which a thin dielectric or no dielectric is interposed between the human body and an antenna, and thus do not use the human body as a dielectric. While the '163 patent further mentions contact with the ear, this is in reference to an "ear-ring" design, that is, the outside of the ear, not the interior of the outer ear, nor the ear canal. Finally, there is no discussion of controlling capacitance by means of a removable sheath, since the design does not deal with the interior of the ear.

U.S. Pat. No. 5,907,522 issued May 25, 1999 to Teodoridis et al for PORTABLE DEVICE FOR RECEIVING AND/OR TRANSMITTING RADIO-TRANSMITTED MESSAGES COMPRISING AN INDUCTIVE CAPACITIVE ANTENNA teaches a bracelet or belt design for use with the torso or wrist of the user, and thus lacks many features of the present invention. It furthermore is an example of the "double antenna" type which both capacitive and inductive antennas are present as separate structures.

U.S. Pat. No. 5,678,202 issued Oct. 14, 1997 to Filimon, et al, COMBINED ANTENNA APPARATUS AND METHOD FOR RECEIVING AND TRANSMITTING RADIO FREQUENCY SIGNALS teaches a conventional telephone shape for a capacitive antenna comprising a rectangle of metal foil on the side of the handset, not a conductive plastic. The device may be held to the ear, thus establishing capacitive contact between the exterior of the ear and the antenna. However, the only reference to a "headset" in the '202 patent is that a non-wireless headset may be plugged i held on the exterior of the ear by a strap across the head, but the capacitive contact between the body and the phone would still occur at the handset and thus NOT at the ear.

U.S. Pat. No. 5,136,303 issued Aug. 4, 1992 to Cho et al for WRIST WATCH TYPE RECEIVER teaches another wrist watch design featuring two structurally distinguishable antenna systems, two contacts, does not use conductive plastic for casing, and has numerous structural differences with the present invention.

U.S. Pat. No. 4,884,252 issued Nov. 28, 1989 to Teodoridis et al for TIMEPIECE INCLUDING AN ANTENNA teaches yet another "two antenna" wrist type system lacking numerous features of the present invention.

All of these patents lack certain features. None teach an ear-piece held in place by means of friction between the ear canal of the user and a shaft inserted therein, and none teach this method of achieving an excellent direct conduction or capacitance connection to the human body for use as an antenna. None teach that an entire case or case bottom may be made of a conductive plastic material in order to achieve the direct or capacitance connection to the human body. All teach either a handset (such as a normal telephone, even if connected to a headset) or else a wrist watch style transmitter: none teach the exclusive use of a headset type device in conjunction with the human body antenna. Finally, none teach the use of a gel layer between an ear canal shaft and the ear canal skin lining of the user in a capacitance antenna.

SUMMARY OF THE INVENTION

General Summary

The present invention teaches a wireless ear-piece headset forming an antenna with the interior of a human ear, especially the ear canal. An antenna in operative connection with such interior of such human ear greatly improves reception and transmission of the device. The antenna may be comprised of a conductive plastic forming the lower body of the ear-piece headset, a sound tube projecting from the body or only a part thereof. The antenna may form an efficient capacitive connection with the body or may form a direct electrical connection.

The wireless ear-piece headset comprises a headset body; a microphone, a transceiver, a receiver and a battery within the headset body, and a sound tube projecting from the headset body. A mini-speaker disposed within the headset body passes sound from the mini-speaker out and into the interior of a human ear.

A removable sheath may be used to ensure safe, comfortable fit and more importantly to control dielectric properties of the antenna system such as distance between the body and sound tube, conductivity, and so on.

Summary in Reference to Claims

It is therefore on aspect, advantage, embodiment and objective of the present invention to teach a wireless ear-piece headset for use with the interior of a human ear, the wireless ear-piece headset comprising: a headset body; a microphone, a transceiver disposed within the headset body, a receiver disposed within the headset body, a battery disposed within the headset body, a sound tube projecting from the headset body and having an aperture; a mini-speaker disposed within the headset body so as to pass sound from the mini-speaker out of the headset body through the aperture and into such interior of such human ear; and an antenna in operative connection with such interior of such human ear.

It is therefore an aspect, advantage, embodiment and objective of the present invention to teach a wireless ear-piece headset wherein the operative connection further comprises one member selected from the group consisting of: direct electrical connection, capacitance connection, and combinations thereof.

It is therefore an aspect, advantage, embodiment and objective of the present invention to teach a wireless ear-piece headset wherein the antenna further comprises a conductive material formed as a portion of the sound tube.

It is therefore an aspect, advantage, embodiment and objective of the present invention to teach a wireless ear-piece headset wherein the antenna further comprises a conductive material formed as the sound tube.

It is therefore an aspect, advantage, embodiment and objective of the present invention to teach a wireless ear-piece headset wherein the antenna further comprises a conductive material formed as a portion of the headset body.

It is therefore an aspect, advantage, embodiment and objective of the present invention to teach a wireless ear-piece headset wherein the antenna further comprises a conductive material formed as the headset body.

It is therefore an aspect, advantage, embodiment and objective of the present invention to teach a wireless ear-piece headset wherein the antenna further comprises a conductive polymer material.

It is therefore an aspect, advantage, embodiment and objective of the present invention to teach a wireless ear-piece headset wherein the antenna further comprises a conductive contact located on the sound tube.

It is therefore an aspect, advantage, embodiment and objective of the present invention to teach a wireless ear-piece headset wherein the antenna is disposed within sound tube, and further wherein the sound tube is thin walled.

It is therefore an aspect, advantage, embodiment and objective of the present invention to teach a wireless ear-piece headset wherein the sound tube is dimensioned and configured to fit within such interior of such ear.

It is therefore an aspect, advantage, embodiment and objective of the present invention to teach a wireless ear-piece headset wherein the sound tube is frictionally engaged to such interior of such ear, and further wherein the wireless ear-piece headset is light weight, whereby the wireless ear-piece headset may be maintained in position.

It is therefore an aspect, advantage, embodiment and objective of the present invention to teach a wireless ear-piece headset further comprising a removable sheath disposed on the sound tube.

It is therefore an aspect, advantage, embodiment and objective of the present invention to teach a wireless ear-piece headset wherein the removable sheath further comprises one member selected from the group consisting of a compliant polymer material, silicon based materials, silicon compounds, elastomeric materials, flexible materials, rubbers, gums, gels, soft silicon like materials, liquids, liquids encased in a compliant shell, and combinations thereof.

It is therefore an aspect, advantage, embodiment and objective of the present invention to teach a wireless ear-piece headset wherein the removable sheath is a conductive material, whereby direct electrical connection between the antenna and such interior of such ear may be established.

It is therefore an aspect, advantage, embodiment and objective of the present invention to teach a wireless ear-piece headset wherein the removable sheath is a dielectric material, whereby direct electrical connection and capacitive connection between the antenna and such interior of such ear may be established.

It is therefore an aspect, advantage, embodiment and objective of the present invention to teach a wireless ear-piece headset wherein the removable sheath is a nonconductive material, whereby capacitive connection between the antenna and such interior of such ear may be established.

DETAILED DESCRIPTION

Figure 1:
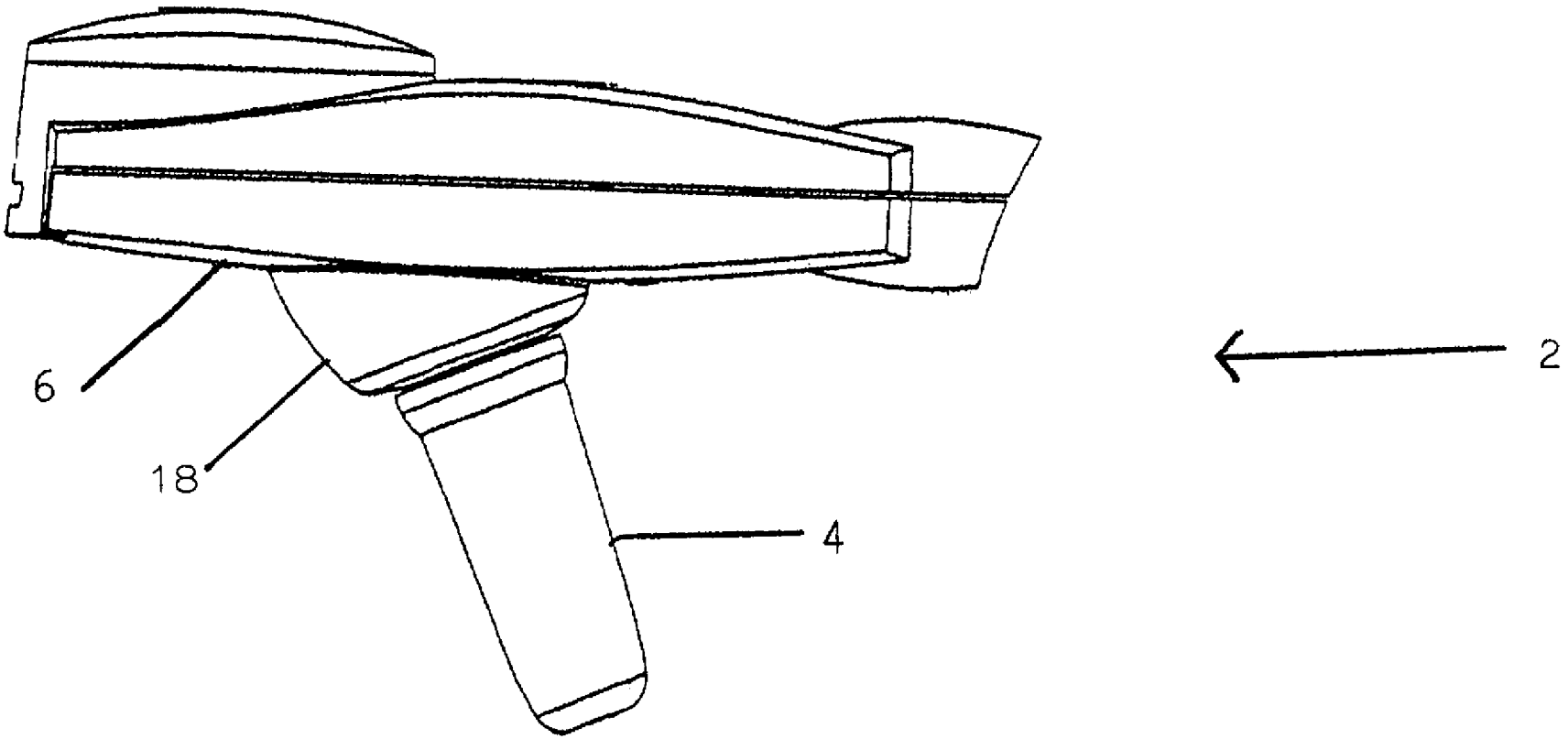
FIG. 1 is a side view of a wireless ear-piece headset embodying the sheath of the preferred embodiment of the invention.
Figure 2:
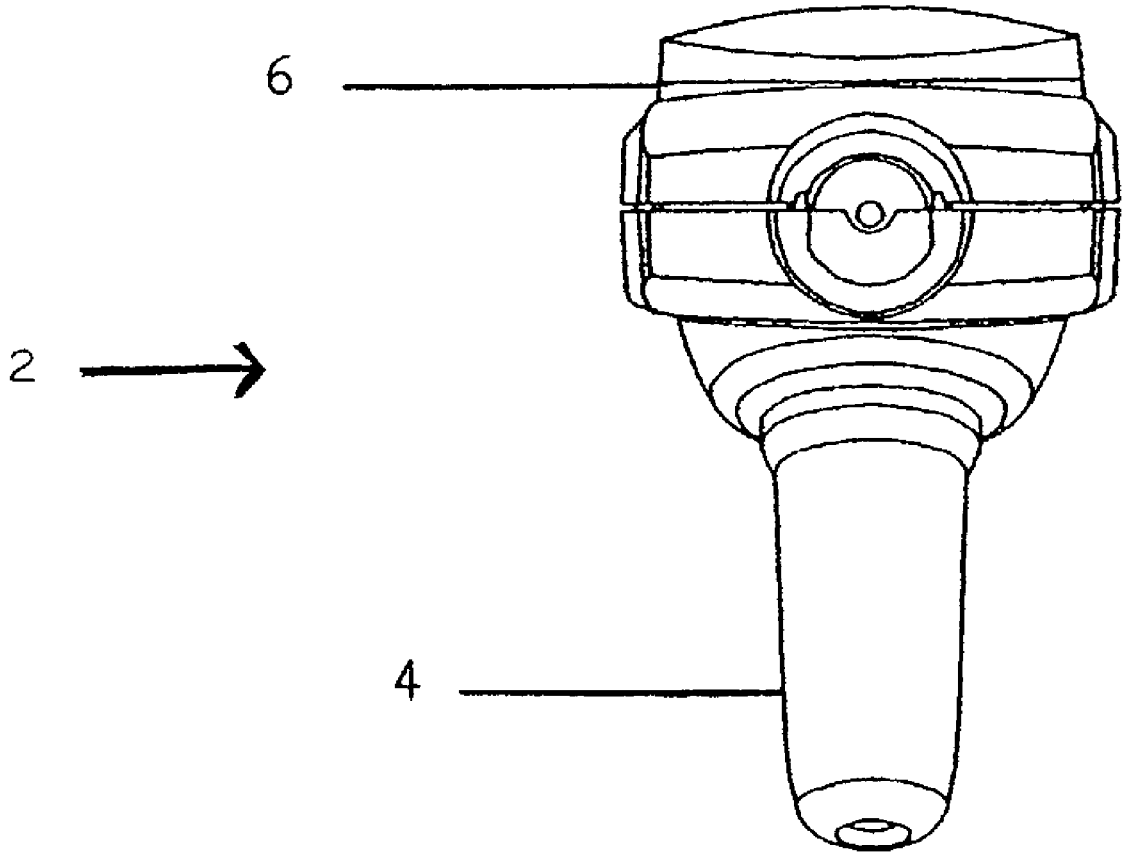
FIG. 2 is an end view of the wireless ear-piece headset of the first embodiment shown in FIG. 1.
Figure 3:
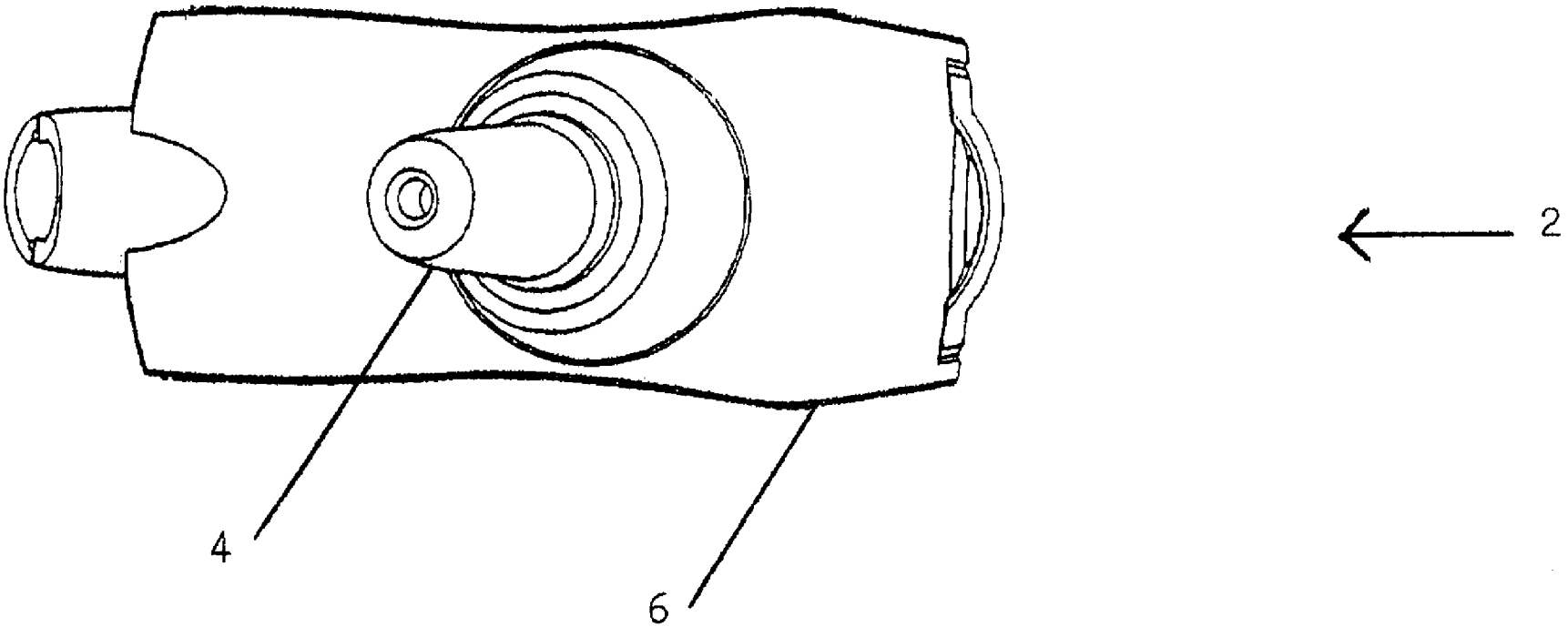
FIG. 3 is a bottom view of the wireless ear-piece headset of the first embodiment shown in FIG. 1.

FIG. 1 is a side view of a wireless ear-piece headset embodying the antenna of the preferred embodiment of the invention. FIG. 2 is an end view of the wireless ear-piece headset of the first embodiment shown in FIG. 1. FIG. 3 is a bottom view of the wireless ear-piece headset of the first embodiment shown in FIG. 1. As seen in these three figures, headset 2 has sound tube assembly 4 which fits into the ear canal (not pictured) of a user. A hemispherical speaker housing 18 of the headset body protrudes enough to fit into the interior of the ear of a user. The ear canal is any and all of that small cavity leading from the outer ear to the inner ear. The outer ear itself also has an interior portion marked by numerous convolutions around the aperture of the ear canal. Both the interior of the outer ear and the ear canal are encompassed by the term "interior of the ear" as used in this application.

Headset body 6 may be a rigid material such as plastic, metal or another more rigid polymer. In general, any projection into the ear canal will be referred to herein as a sound tube such as sound tube 4: the sound tube configuration may vary a good deal in size, shape, form and substance: it may be entirely rigid, semi-rigid, it may be cylindrical, generally cylindrical, irregular, fitted to the ear or another shape. The sound tube will usually have therein either a speaker or an aperture, grill, mesh or other device to allow sound to pass from a mini-speaker in the sound tube or wireless ear-piece headset body 6 to the ear canal of the user, and/or to allow sound to pass the other direction.

Figure 4:
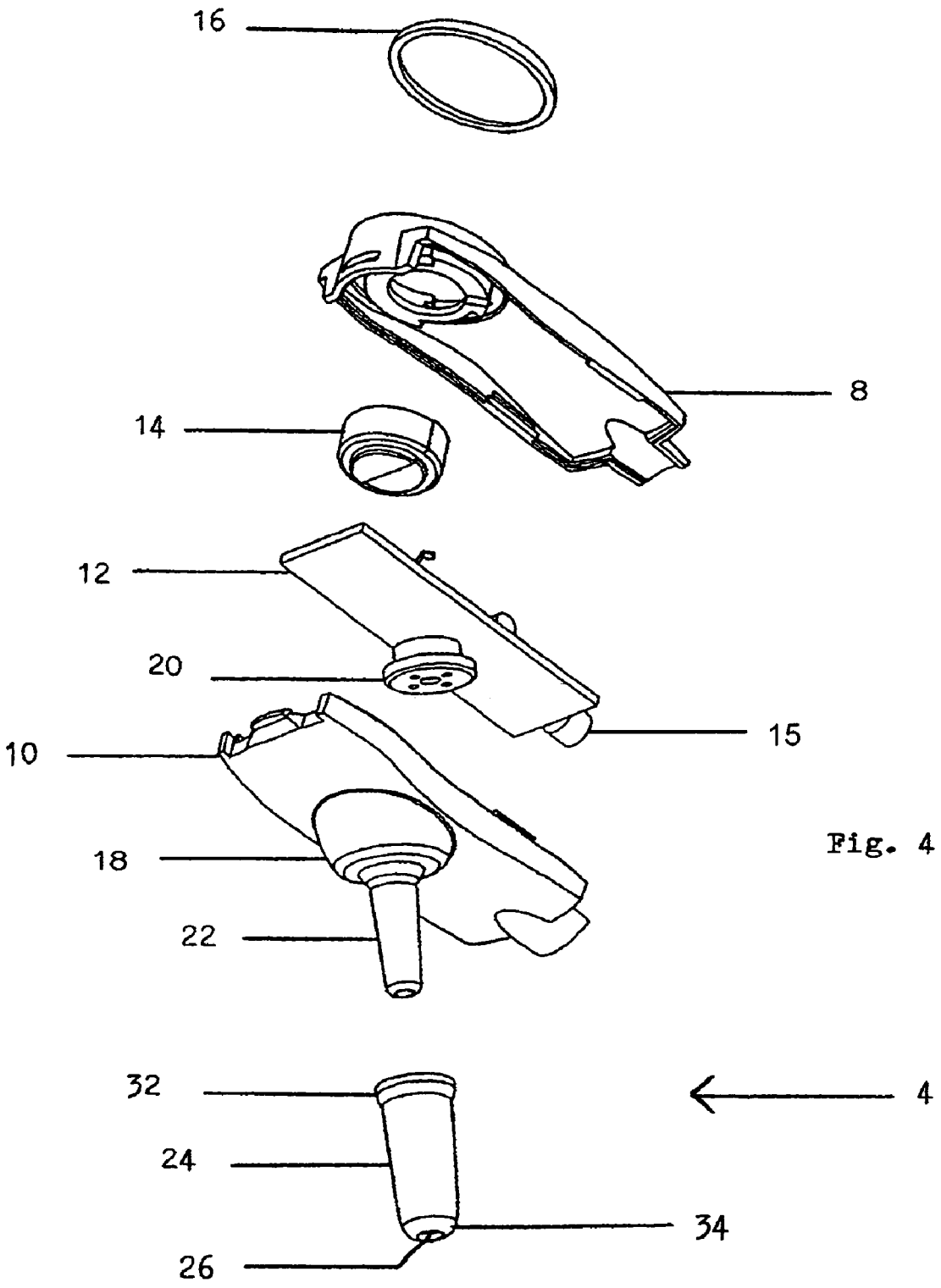
FIG. 4 is an exploded perspective view of the wireless ear-piece headset of the first embodiment shown in FIG. 1.

FIG. 4 is an exploded perspective view of the wireless ear-piece headset of the first embodiment shown in FIG. 1. Lower body 10 is of particular interest, being the antenna of the invention in the preferred embodiment, as will be discussed below. In the best mode now contemplated and presently preferred embodiment of the invention, by means of sound tube assembly 4 of the present invention, the wireless ear-piece headset may miniaturized greatly as no headband or ear clip retainers are necessary. Sound tube assembly 4 will suffice to comfortably hold in place the super miniaturized headset for long periods of time, unlike large headsets having such forms of retainers. Sound tube assembly 4 of the wireless ear-piece headset of the present invention maintains an adequate comfort level. Unlike any known combination of patents taken from related and unrelated technologies, the invention has a removable and replaceable sheath over a permanent, more rigid body (in this case, the sound tube). The aperture in the sound tube 22 is aligned with the aperture in the removable sheath 24 when the sheath 24 is disposed upon the sound tube 22. Friction between the exterior of sound tube 22 and removable sheath 24 retains removable sheath 24 in place on wireless ear-piece headset 2, friction between the exterior of sheath 24 and the interior of the ear, especially the interior of the ear canal, retains headset body 6 of wireless ear-piece headset 2 in place. As used herein, a removable sheath is any removable covering used to cover a projection into the ear canal, regardless of the shapes of the ear canal or projection.

The wireless ear-piece headset of the preferred embodiment of the invention has an upper body 8, a lower body 10 of conductive plastic, a microphone 15, and circuitry 12 disposed in between. In the preferred embodiment, circuitry 12 comprises a printed circuit board with silicon electronic components thereon. Battery 14 provides electrical power, battery 14 may be changed by removing cap 16 (note that while battery 14 is below upper body 8 in FIG. 4, it may be above or co-elevation therewith, even in the preferred embodiment pictured).

The wireless ear-piece headset may include either a receiver or a transceiver allowing both reception and transmission. In receiver embodiments, it may be utilized to carry an audio signal in a passive mode, for example a broadcast radio signal or a signal received from a broadcast unit which itself receives the audio signal from a source such as a television set or radio. In transceiver embodiments, the wireless ear-piece headset may be used in conjunction with a cell phone or similar device to provide true hands free operation without a wire, a bulky headset having an ear clip or head band, and yet with increased comfort and sanitary benefits to the wearer. Not shown but used in alternative embodiments is an impedance and/or capacitance matching circuit used to tune the antenna system (comprising not only the antenna of the unit, but also the human body which becomes part of the system) for best reception. The matching circuit may be used to optimize sensitivity or frequency.

Speaker housing 18 contains mini-speaker 20. One advantage of the method of the present invention is that mini-speaker 20 may be sized, selected and arranged so as to minimize power drain upon battery 14. That is, use of sound tube assembly 4, the wireless ear-piece headset of the present invention may be maintained in very close position to the ear drum of the user, thus minimizing drive current needed for mini-speaker 20. In addition, the configuration of speaker housing 18 includes sound tube 22, which actually projects into the ear canal of the wearer, directing sound precisely at the ear drum of the user and potentially bringing mini-speaker 20 even closer to the ear drum in alternative embodiments. Thus, a smaller speaker, smaller battery and smaller unit are permitted by the invention, thus furthering the convenience of the user. Mini-speaker 20 may be a peizo-electric device, a button speaker, or another type of speaker.

Most important to the present invention is the usage of sound tube assembly 4 to establish an antenna connection with the body of user via the interior of the ear, meaning either the interior of the outer ear or the interior of the ear canal. Lower body 10 is conductive plastic, by which means the antenna connection may be established.

When the present invention is in use, sound tube assembly 4 is inserted into the interior of the ear (sound tube assembly 4 passing into the ear canal and speaker housing 18 into the interior of the outer ear) and the result is either direct connection to the body of the user or else capacitive coupling of the body of the user with the antenna of the invention. The body of the user then becomes part of a larger antenna system. The body of user will pick up radio frequency emissions and thus act to receive transmissions from the base unit of the headset unit (the base unit being attached to a telephone, computer or other device). When the antenna of the invention is used for transmission, the body of the user will radiate transmissions from the headset unit to the base unit. By adding the body of the user to the antenna circuit, a much higher antenna gain may be achieved, 6 dB or more above than could otherwise be achieved with a small internal antenna.

When the antenna is used capacitively, the interior ear to antenna capacitance is dependent upon several factors:

- area of the interior ear in proximity to the antenna
- area of the antenna
- configuration of the antenna to interior ear junction
- thickness of the dielectric materials between the antenna and the interior ear
- dielectric constant or capacitance of the materials between the antenna and the interior ear
- the inverse of the distance between the antenna and the interior ear In regard to configuration, the cylindrical shaft of the sound tube inserted into the cylindrical ear canal is a very favorable configuration for either direct electromagnetic connection or for establishing efficient capacitive contact. In regard to thickness of dielectric materials, capacitance of the materials, and distance between skin and antenna, all of these may be greatly controlled by the use of removable sheath 24. During design of removable sheath 24, all of these factors may be optimized.

Note that the area of the interior ear and the area of the antenna are not entirely controllable, since the size of the user's ear is necessarily varied and the sound tube assembly 4 must be dimensioned and configured to mate with the interior ear.

In general, since the electrical field of the user extends 10 to 20 centimeters from the body, the wireless ear-piece headset of the invention is well within the overall electrical field and may be advantageously coupled to capacitively. By inserting the antenna actually into the ear, this distance is brought to an absolute minimum.

Note that in contrast to the '163 patent discussed earlier, the human body becomes an extension of the antenna and any dielectric is placed between the human body and the invention's antenna.

It is worth noting that because of this very narrow separation, the antenna of the invention may function with both characteristics of direct electromagnetic connection and with characteristics of capacitive coupling. In addition, since in the preferred embodiment the entire lower body 10 is conductive, the interior of the outer ear may be contacted by speaker housing 18 for direct contact at the same time that a strong capacitive coupling is established between sound tube assembly 22 and the interior of the ear canal.

Sound tube assembly 4 is generally cylindrical in the drawings and preferred embodiment, having a slightly conical exterior sheath configuration. In alternative embodiments, sound tube assembly 4 may be more sharply conical in exterior sheath configuration, may be a true cylinder, may be an ogive shape, a rounded shape, parabolic, elliptical, other regular shapes, or it may be an irregular shape or have an exterior sheath configuration specifically designed for the human ear or even for the ear of one or specific individuals. As used herein, the words exterior sheath configuration encompass any shape of the exterior of the sheath. The exterior sheath configuration is dimensioned and configured for (that is, is size, shape, form and substance are suitable for) comfortable use and suspension of the wireless ear-piece headset by means of frictional forces between ear canal and sheath. Thus, placed into the ear, sound tube assembly 4 generates sufficient frictional forces to hold the tiny weight of the wireless ear-piece headset in proper place.

FIG. 4 also displays the removable sheath 24 of the preferred embodiment of the invention. In the preferred embodiment, sound tube assembly 4 furthermore narrows at one end to a small aperture (aperture 26 of FIG. 4). The narrowing in the preferred embodiment takes the form of bevel 34, which terminates in aperture 26. This end is proximate the ear drum of the user and is inserted into the user's ear. At the distal end, removable sheath 24 has an optional circumferential ridge 32 which adds strength to removable sheath 24, aids manipulation of removable sheath 24 by human fingers, and may help to maintain removable sheath 24 on the sound tube of wireless ear-piece headset 2. The size of aperture 26 allow sound transmission between such sound tube and such ear canal. Aperture 26 may be replaced by a pattern of smaller apertures, an aperture having a screen or other members extending across it, and so on.

Removable sheath 24 is retained by friction on the sound tube 4 in the presently preferred embodiment, however, in other embodiments other methods of retention are possible. Actual mechanical cooperation is a strong alternative embodiment. For example, an alternative circumferential ridge may extend inwardly towards the longitudinal axis (long axis) of removable sheath 24, thus presenting a small detente on the inside of removable sheath 24. In such alternative embodiments, the sound tube 22 may have thereon a circumferential groove into which the circumferential ridge may fit, providing mechanical cooperation to hold removable sheath 24 onto sound tube 22. Sheath 24 and sound tube 22 may also be equipped with snaps, belts, fasteners, bumps or other devices for holding sheath 24 onto sound tube 22.

Sheath 24 may be made of a compliant polymer or silicon based material. In addition, may equivalent materials may be employed. Any elastomeric, flexible, material may be used: in addition to polymers and silicon based materials, silicon compounds, rubbers, gums, other materials such as gels, soft silicon-like materials, liquids, liquids encased in a compliant shell, and similar materials. In the preferred embodiment, the silicon compound or polymer is a single phase and a single compound/polymer. In alternative embodiments, mixtures of compounds may be used: mixtures of two or more compounds or polymers (including copolymers, multi-polymers). Such compounds and polymers need not be uniphase bodies but may be polyphase foams, either or open or closed cell foams, or may include other material intrusions or cells such as water or other liquids, other solids which enhance material properties by adding or reducing stiffness, plastic memory, ductility and so on.

In the best mode now contemplated and presently preferred embodiment, the removable sheath is a conductive material, whereby direct electrical connection between the antenna and such interior of such ear may be established. In alternative embodiments, the removable sheath is a dielectric material, whereby direct electrical connection and capacitive connection between the antenna and such interior of such ear may be established. In other alternative embodiments, the removable sheath is a nonconductive material, whereby capacitive connection between the antenna and such interior of such ear may be established.

The construction of removable sheath 24 is subject to numerous alternatives, equivalents and substitutions within the scope of the invention as claimed herein.

While frictional forces may be implicated in retaining the wireless ear-piece headset in the ear of a user in the presently preferred embodiment, in other embodiments, the sheath may be configured so that actual mechanical cooperation between the ear canal and the sheath may serve the same purpose, that is, the convolutions of the ear canal may cooperate with the exterior sheath configuration.

Figure 5:
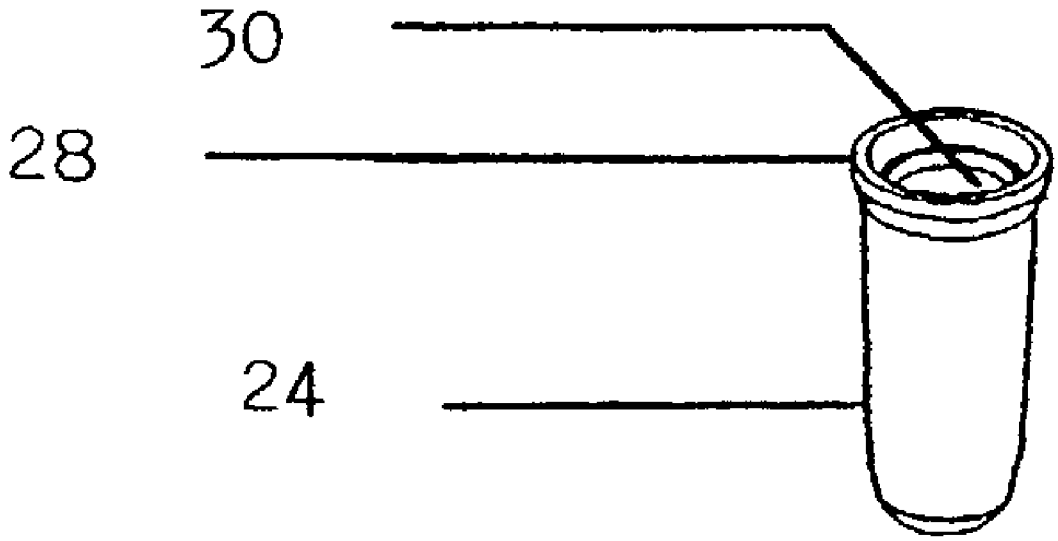
FIG. 5 is a perspective view of the sheath according to a second embodiment of the invention.

FIG. 5 is a perspective view of the sheath according to a second embodiment of the invention. Removable sheath 24 has interior sheath configuration 30, and circumferential ridge 28 about the open end of removable sheath 24. In this embodiment, circumferential ridge 28 is used to aid retention of sheath 4 on sound tube 22 by increasing frictional forces therebetween.

In this embodiment, sheath 4 is provided separately from a wireless ear-piece headset. Sheath 24 of this embodiment may be offered to owners of devices such as the headset which have a sound tube which is inserted into the ear canal.

Sheath 4 may be used as a retrofit to increase the comfort of devices not having such a sheath, or it may be used as a replacement when an original sheath wears out and must be replaced. Polymers, particularly relatively flexible polymers, are prone to becoming oxidized and thus replacement will increase the life span of wireless ear-piece headsets and the like.

However, there are additional very significant advantages to removable and replaceable sheath 4. A device using such a sheath may be used by more than one individual without the unpleasant and unsanitary necessity of inserting the same contact surface into the ears of different individuals. A first user may use a first sheath, while a second user might use a second sheath when the device must be exchanged from ear to ear. By this means there is no chance of transmission of biological materials from ear to ear, and potential squeamishness of multiple users is averted.

Another important advantage relates to comfort. Different people have differing ear canals, meaning that a device comfortable in one person's ear canal might not be comfortably suspended in the ear canal of another. If the second user's ear canal is smaller than the size most comfortably used with a first sheath, the wireless or other device might cause pain when inserted into the ear. If the later users ear canal is larger, however, the fit will be loose; perhaps the device might fall out for this reason. Ear canals also vary in configuration, meaning that sheaths may be provided according to the second embodiment of the invention in different exterior sheath configurations. By the term configuration as used herein, the concepts of shape, size, modulus of elasticity, Young's modulus, flexibility, hardness, size of apertures and so on are all included.

Similarly, interior sheath configuration 30 may vary in order to fit the sound tube upon which it will be placed. Active tense placement of sheath 4 onto a sound tube, and passive tense location of sheath 4 on a sound tube, are both referred to herein as "disposal on the sound tube", and actively taking sheath 4 off of the sound tube, and sheath 4 being found off of a sound tube, are referred to as "removal from sound tube 4".

In alternative embodiments, sheath 24 may be omitted. In such configurations, sound tube 22 may advantageously be used to establish the direct or capacitive operative connection between the antenna of the invention and the body of the user/wearer. In these alternative embodiments, a direct electrical connection between the user's body and the lower body 10 is thus established by the contact between the ear canal and the sound tube 22. In other alternative embodiments, speaker housing 18 projects into the interior of the ear at the outer ear and establishes the connection. Thus in yet other embodiments, rather than the entirety of lower body 10 being constructed of electrically conductive plastic, only speaker housing 18 and/or sound tube 22 are electrically conductive. In yet other embodiments, lower body 10, speaker housing 18 and sound tube 22 may all be non-conductive. In a first subembodiment of this embodiment, an antenna contact passes through an aperture in sound tube 22 or speaker housing 18 or lower body 10 and then makes contact with the body of the user. In a second subembodiment of this embodiment, the antenna is disposed within sound tube 22 and/or speaker housing 18, but establishes a capacitive connection with the body of user via the close proximity of the antenna to the interior of the ear of the user. In these embodiments, sound tube 22, speaker housing 18, lower body 10, individually or in combination may are thin walled. "Thin" in the present application refers to allowing capacitive connection between the antenna of the wireless ear-piece headset and the body of the user via the interior of the ear.

EXAMPLE 1

A wireless ear-piece headset in accordance with the present invention was constructed having a sheath according to the preferred embodiment of the invention. The headset contained a circuit board having integrated chipsets and support components offering transmission and reception of radio waves. An ancillary base unit allowed the headset to cooperate with a telephone or similar device to provide hands free operation. By means of the present invention, the device has no ear clip, no head band and no retainer other than the sheath of the present invention, and thus the wireless ear-piece headset is substantially miniaturized over products presently on the market. The sheath was narrower at the proximal end (inserted into the ear canal) than at the distal end. The end of the sheath is chamfered for further comfort and ease of use, with an aperture allowing passage of sound from the body of the wireless device to the ear canal of the user.

The body portions of the wireless device are a hard plastic material, but may be constructed of metal or other relatively hard materials.

The sheath is composed of a compliant silicon based compound or polymer.

In use, the sound tube, sheath disposed thereon, is inserted into one ear of the user. A microphone at the lower end of the device picks up the user's voice for transmission to a base unit connected to a cell phone, ordinary phone or equivalent device. A receiver in turn picks up transmissions from the base unit and converts them to audio using a mini-speaker located at the base of the sound tube. Sound from the mini-speaker travels from the sound tube, through the sound tube aperture and sheath aperture and thus to the ear canal of the user.

The cylindrical sound tube projecting into the ear canal of the user establishes an efficient capacitive connection between the conductive plastic of the sound tube and the ear canal and thus creates a larger antenna system comprising both the human body of the user and the antenna portion of the headset body. During transmission, the body of the user becomes a radiant medium for transmission and during reception, the body of the user responds to impinging RF transmissions and passes them to the antenna.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A wireless ear-piece headset for use with the interior of a human ear, the wireless ear piece headset comprising:

a headset body;

a microphone;

circuitry for transmitting and receiving radio waves disposed within the headset body;

a battery disposed within the headset body;

a sound tube projecting from the headset body and having an aperture;

a mini-speaker disposed within the headset body so as to pass sound from the mini-speaker out of the headset body through the aperture and into such interior of such human ear; and an antenna adapted for operable connection with the interior of said human ear, wherein the antenna further comprises a conductive material formed as a portion of the sound tube.

2. The wireless ear-piece headset of claim 1, wherein the operative connection further comprises one member selected from the group consisting of: direct electrical connection, capacitance connection, and combinations thereof.

3. The wireless ear-piece headset of claim 1, wherein the antenna further comprises a conductive material formed as the sound tube.

4. The wireless ear-piece headset of claim 1, wherein the antenna further comprises a conductive contact located on the sound tube.

5. The wireless ear-piece headset of claim 1, wherein the antenna is disposed within sound tube, and further wherein the sound tube is thin walled.

6. The wireless ear-piece headset of claim 1, wherein the sound tube is dimensioned and configured to fit within the interior of said ear.

7. The wireless ear-piece headset of claim 6, wherein the sound tube is frictionally engaged to the interior of said ear, and further wherein the wireless ear-piece headset is light weight, whereby the wireless ear-piece headset may be maintained in position.

8. The wireless ear-piece headset of claim 1, further comprising a removable sheath disposed on the sound tube.

9. The wireless ear-piece headset of claim 8, wherein the removable sheath further comprises one member selected from the group consisting of a compliant polymer material, silicon based materials, silicon compounds, elastomeric materials, flexible materials, rubbers, gums, gels, liquids, liquids encased in a compliant shell, and combinations thereof.

10. The wireless ear-piece headset of claim 8, wherein the removable sheath is a conductive material, whereby direct electrical connection between the antenna and the interior of said ear may be established.

11. The wireless ear-piece headset of claim 8, wherein the removable sheath is a dielectric material, whereby direct electrical connection and capacitive connection between the antenna and the interior of said ear may be established.

12. The wireless ear-piece headset of claim 8, wherein the removable sheath is a nonconductive material, whereby capacitive connection between the antenna and the interior of said ear may be established.

13. A wireless ear-piece headset for use with the interior of a human ear, the wireless ear piece headset comprising:

a headset body;

a microphone;

circuitry for transmitting and receiving radio waves disposed within the headset body;

a battery disposed within the headset body;

a sound tube projecting from the headset body and having an aperture;

a mini-speaker disposed within the headset body so as to pass sound from the mini-speaker out of the headset body through the aperture and into such interior of such human ear; and an antenna adapted for operable connection with the interior of said human ear, wherein the antenna further comprises a conductive polymer material formed as the headset body.

14. A wireless ear-piece headset for use with the interior of a human ear, the wireless ear piece headset comprising:

a headset body;

a microphone;

circuitry for receiving radio waves disposed within the headset body;

a battery disposed within the headset body;

a sound tube projecting from the headset body and having an aperture;

a mini-speaker disposed within the headset body so as to pass sound from the mini-speaker out of the headset body through the aperture and into such interior of such human ear; and an antenna adapted for operable connection with the interior of said human ear, wherein the antenna further comprises a conductive material formed as a portion of the sound tube.

15. The wireless ear-piece headset of claim 14, wherein the operative connection further comprises one member selected from the group consisting of direct electrical connection, capacitance connection, and combinations thereof.

16. The wireless ear-piece headset of claim 14, wherein the antenna further comprises a conductive material formed as the sound tube.

17. The wireless ear-piece headset of claim 14, further comprising a removable sheath disposed on the sound tube.

18. The wireless ear-piece headset of claim 17, wherein the removable sheath further comprises one member selected from the group consisting of a compliant polymer material, silicon based materials, silicon compounds, elastomeric materials, flexible materials, rubbers, gums, gels, liquids, liquids encased in a compliant shell, and combinations thereof.

19. A wireless ear-piece headset for use with the interior of a human ear, the wireless ear piece headset comprising:

a headset body;

a microphone;

circuitry for receiving radio waves disposed within the headset body;

a battery disposed within the headset body;

a sound tube projecting from the headset body and having an aperture;

a mini-speaker disposed within the headset body so as to pass sound from the mini-speaker out of the headset body through the aperture and into such interior of such human ear; and an antenna adapted for operable connection with the interior of said human ear wherein the antenna further comprises a conductive polymer material formed as a portion of the headset body.

20. The wireless ear-piece headset of claim 19, wherein the antenna further comprises a conductive polymer material formed as the headset body.

21. A wireless ear-piece headset for use with the interior of a human ear, the wireless ear piece headset comprising:

a headset body;

a microphone;

circuitry for receiving radio waves disposed within the headset body;

a battery disposed within the headset body;

a sound tube projecting from the headset body and having an aperture;

a mini-speaker disposed within the headset body so as to pass sound from the mini-speaker out of the headset body through the aperture and into such interior of such human ear; and an antenna adapted for operable connection with the interior of said human ear, wherein the antenna further comprises a conductive contact located on the sound tube.

22. A wireless ear-piece headset for use with the interior of a human ear, the wireless ear piece headset comprising:

a headset body;

a microphone;

circuitry for receiving radio waves disposed within the headset body;

a battery disposed within the headset body;

a sound tube projecting from the headset body and having an aperture;

a mini-speaker disposed within the headset body so as to pass sound from the mini-speaker out of the headset body through the aperture and into such interior of such human ear; and an antenna adapted for operable connection with the interior of said human ear, wherein the antenna is disposed within the sound tube, and further wherein the sound tube is thin walled.

23. The wireless ear-piece headset of claim 22, wherein the sound tube is dimensioned and configured to fit within the interior of said ear.

24. The wireless ear-piece headset of claim 23, wherein the sound tube is frictionally engaged to the interior of said ear, and further wherein the wireless ear-piece headset is light weight, whereby the wireless ear-piece headset may be maintained in position.

25. A wireless ear-piece headset for use with the interior of a human ear, the wireless ear piece headset comprising:

a headset body;

a microphone;

circuitry for receiving radio waves disposed within the headset body;

a battery disposed within the headset body;

a sound tube projecting from the headset body and having an aperture;

a mini-speaker disposed within the headset body so as to pass sound from the mini-speaker out of the headset body through the aperture and into such interior of such human ear; and an antenna adapted for operable connection with the interior of said human ear; and a removable sheath disposed on the sound tube, whereby direct electrical connection between the antenna and the interior of said ear may be established.

26. The wireless ear-piece headset of claim 25, wherein the removable sheath is a dielectric material, whereby direct electrical connection and capacitive connection between the antenna and the interior of said ear may be established.

27. The wireless ear-piece headset of claim 25, wherein the removable sheath is a nonconductive material, whereby capacitive connection between the antenna and the interior of said ear may be established.

* * * * *